United States Patent [19]

Stahlecker et al.

[11] Patent Number: 4,676,060

[45] Date of Patent: Jun. 30, 1987

[54] OPEN-END SPINNING MACHINE WITH A PLURALITY OF SPINNING UNITS HAVING A MOVABLE MAINTENANCE DEVICE

[76] Inventors: Fritz Stahlecker, Josef-Neidhart-Strasse 18, 7347 Bad Überkingen; Hans Stahlecker, Haldenstrasse 20, 7334 Suessen, both of Fed. Rep. of Germany

[21] Appl. No.: 841,232

[22] Filed: Mar. 19, 1986

[30] Foreign Application Priority Data

Mar. 20, 1985 [DE] Fed. Rep. of Germany ..... 3510004

[51] Int. Cl.[4] ..... D01H 15/02

[52] U.S. Cl. ..... 57/263

[58] Field of Search ..... 57/22, 263

[56] References Cited

U.S. PATENT DOCUMENTS

| | | | |
|---|---|---|---|
| 3,540,201 | 11/1967 | Susami et al. | 57/263 X |
| 3,601,969 | 8/1971 | Susami et al. | 57/263 |
| 3,962,855 | 6/1976 | Stahlecker | 57/263 |
| 3,999,362 | 12/1976 | Schulz et al. | 57/263 |
| 4,114,356 | 9/1978 | Eckhardt | 57/263 |
| 4,367,623 | 1/1983 | Parker et al. | 57/263 |
| 4,537,020 | 8/1985 | Fuchs | 57/263 |
| 4,539,804 | 9/1985 | Derichs | 57/263 |
| 4,541,233 | 9/1985 | Raasch et al. | 57/263 |
| 4,541,235 | 9/1985 | Raasch | 57/263 |
| 4,570,430 | 2/1986 | Stahlecker | 57/263 |

*Primary Examiner*—Donald Watkins

*Attorney, Agent, or Firm*—Barnes & Thornburg

[57] ABSTRACT

An open-end friction spinning machine is provided having a plurality of adjacently arranged spinning units and a movable start-spinning device capable of attachment to a spinning unit requiring service. The broken yarn end for the start-spinning process is returned into the spinning unit against the normal yarn withdrawal direction. In order to safely accomplish the return of the yarn into the area of the friction spinning region which is preferably formed by two adjacently arranged rollers forming a wedge-shaped gap therebetween, a compressed air jet is provided which returns the yarn end through the friction spinning zone.

23 Claims, 6 Drawing Figures

OPEN-END SPINNING MACHINE WITH A PLURALITY OF SPINNING UNITS HAVING A MOVABLE MAINTENANCE DEVICE

BACKGROUND AND SUMMARY OF THE INVENTION

The invention relates generally to an open-end friction spinning machine with a plurality of adjacently arranged spinning units each containing means for forming a yarn formation zone for the spinning of yarn, a feeding and opening device for supplying individual fibers to the yarn formation zone, a suction device for holding the fibers and the yarn being produced in the yarn formation zone and a withdrawal device for withdrawing the yarn from the yarn formation zone. Additionally provided are a winding or spooling device for collecting the spun yarn on a spool and a movable maintenance device capable of engagement with a spinning unit requiring service. This maintenance device includes devices for taking-up a broken yarn end at the respective spinning unit, devices for returning the yarn end to the spinning unit, devices for controlling the supply of fibers to the friction zone, devices for controlling the withdrawal of start-spun yarn out of the yarn formation zone, and devices for controlling the resumption of taking-up the piecing yarn onto the spool.

An open-end friction spinning machine is disclosed in DE-OS No. 33 25 928 which includes a plurality of adjacently arranged spinning units and a movable maintenance device for conducting a start-spinning process following a yarn break. The movable maintenance device is equipped with devices for detecting the broken yarn end and for returning the same into the spinning unit. Thereby the spinning unit is opened first to expose the area of the wedge-shaped gap which serves as the yarn formation zone. The broken yarn end is then introduced into a component part pivoted open and containing the fiber feed channel. The introduction of the yarn end is supported by a compressed air nozzle or jet which is part of the movable maintenance device. Subsequent thereto, the component part is pivoted back into the operational position, thereby closing the spinning unit. A vacuum is produced by means of a suction pipe in the area of the yarn formation zone which consists of the wedge-shaped gap formed by two rollers. This vacuum draws the yarn end further into the spinning unit and thereby into the suction pipe. The suction pipe is attached to the spinning unit. This suction pipe is connectable to a vacuum supply line forming part of the movable maintenance device.

An objective of the present invention is the provision of an open-end friction spinning machine with a movable maintenance device in such a manner that the return of the broken yarn end is simplified and functionality of the unit is improved.

These and other objectives of the present invention are achieved by providing an air current device controlled by the maintenance device for producing an air current extending over the yarn formation zone of a spinning unit. The air current means are suitable for returning a yarn end against the normal yarn withdrawal direction, and include at least one compressed air nozzle. The blowing direction of the nozzle is directed against the normal yarn withdrawal direction essentially in the longitudinal direction of the yarn formation zone according to a preferred embodiment.

This arrangement makes the return of the yarn end in a closed spinning unit possible. Additionally, a very effective transport air current is produced by means of the compressed air nozzle for the return of the yarn end.

In a further development of certain preferred embodiments of the invention, each spinning unit is provided with a yarn withdrawal pipe designed as an extension of the yarn formation zone which for producing a compressed air current directed against the yarn withdrawal direction is connected to a compressed air source. In a simple fashion, the yarn withdrawal pipe also serves as the compressed air nozzle which carries out the return transport of the yarn end within the spinning unit via the yarn formation zone. It is advantageously contemplated that the yarn withdrawal pipe of each spinning unit be provided with a channel entering the unit in a sloped orientation against the yarn withdrawal direction, serving as a compressed air supply line which leads to a compressed air source. An air current is thereby produced within the yarn withdrawal pipe of the kind known with ejector pumps which may also be used for taking in the yarn end presented in the area of the outlet of the yarn withdrawal pipe. In addition, the yarn withdrawal pipe then also serves as a compressed air nozzle. Since there exists a transport air current produced by a compressed air source within the yarn withdrawal pipe, the same may exhibit any desired path and especially may include one or several deflections of the yarn path without disturbing the return transport of the yarn end.

In a further development of certain preferred embodiments of the invention the maintenance device includes a compressed air supply line attachable to the compressed air nozzle of a spinning unit requiring service. The compressed air nozzle which, for example, could be the yarn withdrawal pipe, is stationarily attached to each spinning unit and directed to the yarn formation zone. The supply line of the movable maintenance device need only be attached, without the movable maintenance device having to adjust the air nozzle in relation to the yarn formation zone of the spinning unit.

With another preferred embodiment of the invention, a compressed air nozzle connected to a compressed air supply line is included in the maintenance device that is attachable to a spinning unit requiring service.

In another preferred embodiment of the invention it is provided that the means for producing an air current in the area of the yarn formation zone directed against the normal yarn withdrawal direction include a suction nozzle controllable by the maintenance device. As a result, the yarn end is returned, and upon entering the suction nozzle, takes on a precisely defined position in the spinning unit.

In a further development of certain preferred embodiments of the invention the maintenance device is equipped with a device for detecting the yarn end drawn in by the suction nozzle. The maintenance device is thereby given the opportunity to examine whether the yarn end has been returned and whether, as a result thereof, the requirements for a successful piecing process are met.

In another development of certain preferred embodiments of the invention, the maintenance device is equipped with means for piecing and/or treating of the yarn end to be drawn in by the suction nozzle. These measures make it possible to piece the returned yarn end to an exact length and to treat same, if necessary, upon its return so that the prerequisite for a successful piecing process are further improved.

In a further development of certain preferred embodiments of the invention, each spinning unit is equipped with means for interrupting a drive unit of the friction surface means forming the yarn formation zone, and the maintenance device includes control means for controlling the means for interrupting the drive unit. As a consequence, the movable maintenance device is capable of disengaging the drive of the friction surface means defining the yarn formation zone, thereby avoiding any disturbance by the friction surface means during the return of the yarn end.

In a further development of the invention each spinning unit is equipped with means for interrupting the suction effect of the suction device attached to the respective yarn formation zone, and the maintenance device includes means for controlling the means for interrupting the suction effect. Furthermore, by providing that the maintenance device is capable of interrupting the suction effect, any negative influence of the suction effect in the area of the yarn formation zone during the return of the yarn end is avoided.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
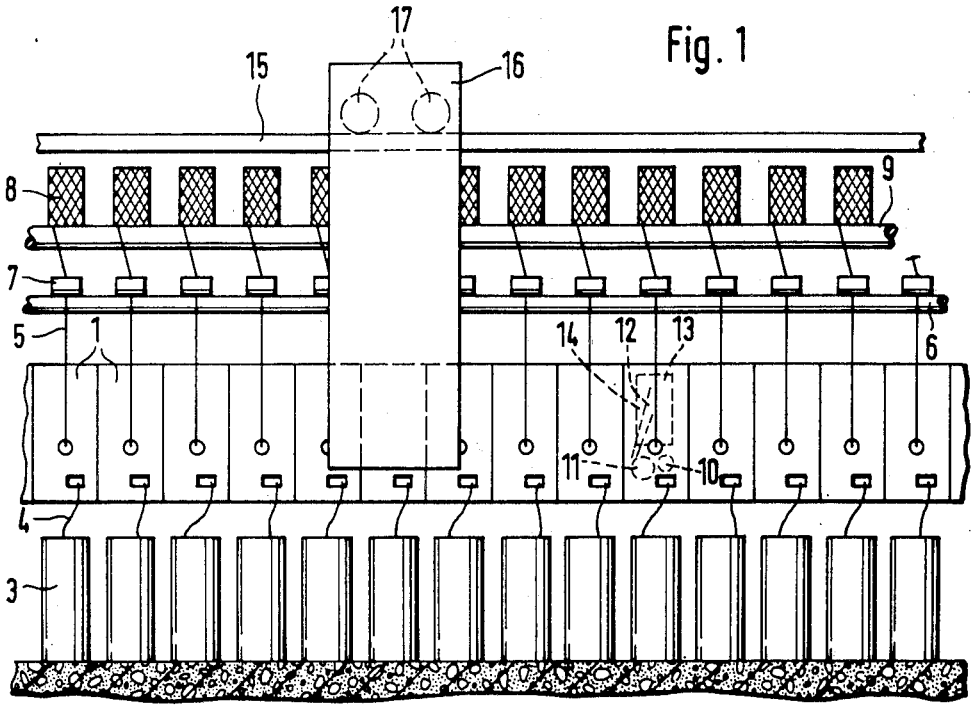
FIG. 1 is a schematic front view of a section of an open-end friction spinning machine having a plurality of adjacently arranged spinning units and a movable maintenance device in accordance with the present invention.

In the following, a preferred embodiment of the present invention is described based upon an open-end friction spinning machine and respective spinning units 1 whereby a wedge-shaped gap 18 formed by two adjacently arranged rollers 13 and 14, serves as the yarn formation zone. In the same manner, the invention may also be realized with friction spinning units having other means for forming the yarn formation zones such as a single friction surface rotating transversely relative to the yarn withdrawal direction (i.e. having an axis of rotation parallel to the yarn formation zone) or, for example, two rollers, one of which is contained within the other with each roller having different diameters and forming a yarn formation zone in between.

The spinning units 1 of the open-end friction spinning machine are adjacently arranged in a row and are identical with respect to each other. Each spinning unit 1 is supplied with a fiberband 4 out of a fiberband container 3. The fiberband is spun into a yarn 5 by the spinning members arranged within the spinning unit 1. The produced yarn 5 is withdrawn from the spinning unit 1 by means of a yarn withdrawal device which includes a subcylinder that is continuously driven in a longitudinal direction of the machine and a respective pressure roller 7. Subsequently, the yarn 5 is spooled to a cross spool 8 which is driven by a winding roller 9 that is continuously driven in the longitudinal direction of the machine. Each spinning unit 1 includes a feeding roller 10 which together with a weighting component draws the fiberband 4 into the spinning unit 1. The feeding roller 10 is followed by a faster rotating opening roller 11 which opens up the fiberband 4 into individual fibers. The individual fibers are then carried via a fiber feeding channel 12 from the opening roller 11 to a yarn formation zone formed by two rollers 13 and 14.

The rollers 13 and 14 (FIG. 2) are arranged in a roller housing 22 covered by a lid-type component 20 which contacts the roller housing 22 by means of partitioning lines 23. By swivelling away the lid-type component 20, rollers 13 and 14 and especially the wedge-shaped gap 18 formed by the same and serving as yarn formation zone or friction zone are made accessible for maintenance purposes. The lid-type component 20 contains a portion of the fiber feeding channel 12 and rests with its slit-like mouth 19 opposite the area of the wedge-shaped gap 18. The fibers are twisted together in the wedge-shaped gap 18 to yarn 5 wherein rollers 13 and 14 are driven in the same rotational direction as shown by arrows A and B. Rollers 13 and 14 are driven by a drive belt 52 (FIG. 4) contacting both rollers, which in turn is driven by an electromotor 54 via a drive disk 53.

Figure 2:
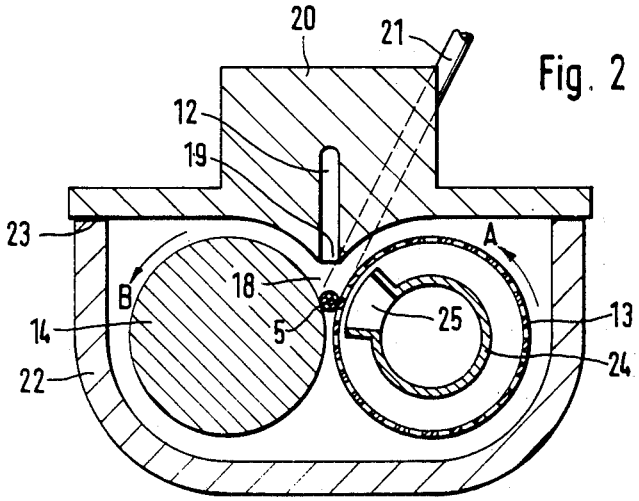
FIG. 2 is a sectional view through a spinning unit of an open-end friction spinning machine in accordance with FIG. 1, wherein the yarn formation zone is embodied as a wedge-shaped gap defined by two adjacently arranged rollers drivable in the same rotational direction.

Rollers 13 and 14 are directly supported upon pipes 24 by means of roller bearings 48 of which at least one pipe 24 corresponding to the roller 13, is arranged as a so-called suction pipe. The roller 13 has a perforated cylindrical surface, while roller 14 as indicated in FIG. 2 contains a closed shell surface. In a modification of the shown embodiment it is certainly also contemplated to provide roller 14 with a perforated shell surface in a corresponding manner and to position roller 14 the upon a suction pipe. The suction pipe 24 closed on one side is connected with its other end via a manifold 49 to a vacuum supply line 50 that includes a blocking valve 51. The suction pipe 24 is provided with a suction slot 25 (FIG. 2) directed at the wedge-shaped gap 18 by means of which an air current is sucked through the shell surface of roller 13 into the area of the wedge-shaped gap 18. This air current, on the one hand, serves to retain the produced yarn 5 in the area of the wedge-shaped gap 18, while, on the other hand, it produces a transport air current in the fiber feed channel 12 for supplying the individual fibers to the friction zone.

The feeding and opening device 57 (FIG. 4) includes a feeding roller 10, the drive shaft of which is supported in a pipe 58 stationarily retained by means of a retaining element 59. The shaft of the feeding roller 10 carries a toothed wheel 60 which engages with a toothed wheel 61 rotatably and fixedly arranged upon shaft 62 that is continuously driven in the longitudinal direction of the machine. An electromagnetic coupling 63 is arranged between the shaft of the feeding roller 10 and the toothed wheel 60 that is connected via an electrical line 64 to a not further illustrated yarn breakage detector. The yarn breakage detector which is preferably arranged in front of the yarn withdrawal device 6, 7 controls the electromagnetic coupling 63 in such a manner that the same is opened in case of a yarn breakage thereby interrupting the continuous supply of the fiber-band 4.

The opening roller 11 of the feeding and opening device 57 is contained in an opening roller housing 65 having an extension 66 which bears a shaft 67 of the opening roller 11. The shaft 67 protrudes from the extension 66 at the side opposite the opening roller 11 and is driven continuously in the machine longitudinal direction by means of a tangential belt 68. The tangential belt 68 is pressed against shaft 67 by means of a tensioning roller 69 which also guides the returning drum 70 of the tangential belt 68. The opening roller 11 is continuously driven during operation of the open-end friction spinning machine, i.e., the same is not interrupted even during a yarn breakage.

A first section 74 of the fiber feed channel 12 is located in the opening roller housing 65 and continues in the form of the second section 75 arranged in the lid-type component 20. A slide guidance means 76 is provided between the two sections 74 and 75 of the fiber feeding channel 12. The lid-shaped component 20 is fixedly attached to a jacket 77 of the spinning unit 1 which is pivotable about a swivel axis 27 located underneath the feeding and opening device 57 for exposing at least rollers 13 and 14, but preferrably also other parts.

Figure 4:
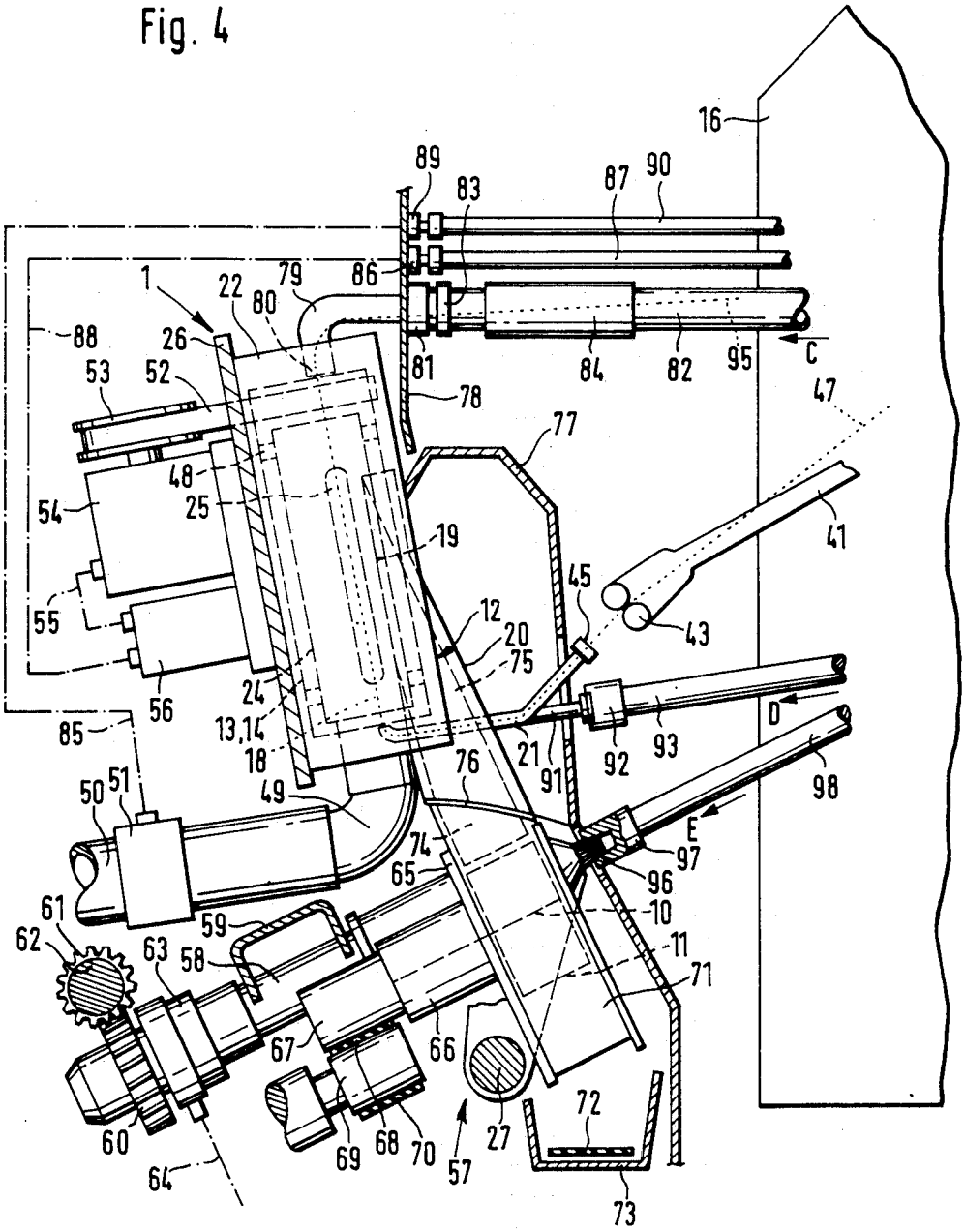
FIG. 4 is a partial sectional view and a partial side view of a spinning unit and a movable maintenance unit servicing the unit in an enlarged scale in accordance with the present invention.

As can be seen from FIG. 4, the supply of the single fibers is accomplished via the fiber feeding channel 12 which extends in the longitudinal direction of the wedge-shaped gap 18 with a slit-like mouth 19 in a sloped direction from underneath and with a relative small angle deviation to the wedge-shaped gap 18 that slopes almost vertically and in a slight angle from behind.

Figure 3:
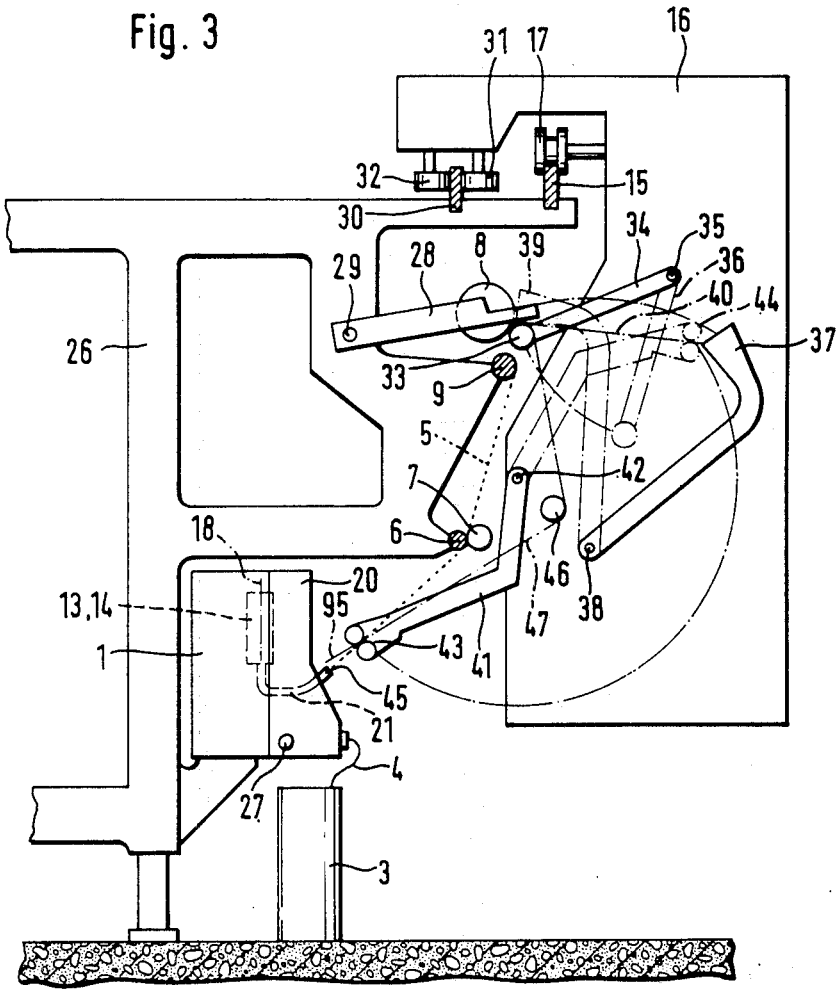
FIG. 3 is a vertical sectional side view through an open-end friction spinning machine at a spinning unit and a movable maintenance device servicing the unit in accordance with the present invention.

The withdrawal direction F of yarn 5 is directed downwardly, which means essentially against the supply direction of the single fibers. In withdrawal direction F, the wedge-shaped gap 18 is arranged with a yarn withdrawal pipe 21 that originates approximately in extension of the wedge-shaped gap 18, is bent almost horizontally, and follows the section protruding jacket 77 upwardly sloped in withdrawal direction 6, 7. FIG. 3 shows the course of yarn 5 by means of a dotted line starting from the outlet opening 45 of the yarn withdrawal pipe 21 to the spool 8.

The open-end friction spinning machine is provided with a movable maintenance device 16 including means for accomplishing a start spinning process following a yarn breakage. These start spinning means are only schematically depicted in FIG. 3 and FIG. 4. The maintenance device 16 is moved by means of running wheels 17 of which at least one is continuously driven upon a rail 15 arranged above the spinning unit 1 at a machine frame 26. Additionally it is supported at another rail 30 by means of guidance wheels 31 and 32. In the event of a yarn breakage, the maintenance unit 16 is called to the respective spinning unit requiring maintenance. The maintenance device 16 is further equipped with means for opening the spinning unit 1 by swivelling away the machine jacket 77 and thereby the lid-like component 20, for exposing the area of the wedge-shaped gap 18, and to subsequently conduct a cleaning process especially in the area of the wedge-shaped gap 18. The specific cleaning means are not illustrated.

Following the maintenance or servicing process, the spinning unit 1 is again closed by swivelling back the jacket 77 and the lid-type component whereupon the actual start-spinning process is activated. The maintenance device 16 must first locate the broken yarn end. The shown embodiment (FIG. 3) provides that a spool frame 28 pivotable about an axis 29 is lifted up together with spool 8. The spool 8 is assigned an auxiliary winding roller 33 which is arranged upon an arm of the maintenance device 16 and is pivotable around an axis 35 between the dotted-line position 36 and the position shown with straight lines. The auxiliary winding roller 33 may be driven in both rotational directions.

The maintenance device 16 includes a locator nozzle 37 swivelled around a swivel axis 38 which nozzle is connected in a not further described manner to a subpressure source of the maintenance device 16. The locator nozzle 37 is moved from the position shown in straight lines into the position 39 of spool 8 indicated in dotted lines. Thereafter the auxiliary winding roller 33 of spool 8 is driven against its normal winding direction whereby the broken yarn end is acted on by a suction force. The yarn locator nozzle 37 is then pivoted back in its position shown with straight lines carrying along a found yarn end 40 which extends from the auxiliary winding roller 33 to the yarn locator nozzle 37.

The yarn end is picked up in the area of the yarn locator nozzle 37 by means of a yarn transfer device which includes an arm 41 located in the maintenance device 16 and pivotable around an axis 42. At its end, the arm 41 has a clamping roller pair 43 which can be moved apart from each other and can be driven in both rotational directions. The yarn transfer device is first in a position 44 shown in dotted lines in which the clamping roller pair 43 is first opened, then closed and takes on the yarn end 40. Subsequently thereto the arm 41 during continuous driving of the auxiliary winding roller 33, is pivoted into the position shown with straight lines in which the clamping roller pair 43 holding the yarn end 95 with the yarn end protruding out, takes on a position opposite the outlet opening 45 of the yarn withdrawal channel 21.

A cutting or piecing device is arranged in the area of the yarn locator nozzle 37 which, prior to the pivoting of the yarn transfer device, facilitates piecing of the yarn end 40 thereby producing the end 95. While pivoting the transfer device, the yarn is positioned around a yarn guiding element 46 of the maintenance device 16 in the area of the yarn withdrawal pipe 21. The returned yarn takes on the course indicated in dotted line in FIG. 3 between the spool 8 and the outlet opening 45 of the yarn withdrawal pipe 21.

In accordance with the above described steps, the yarn end 95 has to be returned in the spinning unit 1 such that the same is positioned in the area of the wedge-shaped gap 18 and is made available for a start-spinning process. The means for this process are shown in FIG. 4. The yarn withdrawal pipe 21 is provided with a channel 91 entering obliquely against the normal withdrawal direction F which is assigned a compressed air supply line 93 having a connector element 92 in Arrow direction D. The yarn withdrawal pipe 21 by way of connector 92 of the compressed air supply line 93 now serves as a compressed air nozzle. The inlet opening of the yarn withdrawal pipe 21 positioned in a compressed extension of the wedge-shaped gap 18, produces an air current in direction of the wedge-shaped gap 18 against the yarn withdrawal direction F. Simultaneously a suction air current is produced in the manner of an ejector pump in the area of the outlet opening 45 of the yarn withdrawal pipe 21, which sucks in the yarn end 95 into the yarn withdrawal pipe 21.

The clamping roller pair 43, during the blowing of the air current into the yarn withdrawal pipe 21, is driven in return delivery direction, i.e. against the normal yarn withdrawal direction. At the same time the auxiliary winding roller 33 is also driven in the unwinding direction thereby returning the yarn end 95 into the spinning unit 1.

A suction pipe 79 is arranged at the end and as an extension of the wedge-shaped gap 18, the end facing away from the yarn withdrawal channel 21, which suction pipe is bent and protrudes outwardly out of the jacket 78 of the spinning unit 1 and attaches there to a connecting element 81. This connector 81 is assigned via a connector 83 in direction of Arrow C a suction line 82 connected to a not further illustrated vacuum source. The connecting element 83 is preferably arranged such that it includes a valve which, once in contact with connecting element 81 of suction pipe 79, opens automatically. The yarn end 47 is redelivered by the suction nozzle 80 of suction pipe 79 until its end 95 reaches into the suction line 82. The returned yarn end 47 is consequently first transported via the area of the wedge-shaped gap 18 by means of the yarn withdrawal pipe 21 acting as compressed air nozzle, and is subsequently picked up by the suction pipe 79.

In order not to disturb the transport of the yarn end 47 over the area of the wedge-shaped gap 18, the shown embodiment contemplates interrupting not only the suction air current produced by the suction pipe 24, but also to discontinue operation of the friction rollers 13 and 14. The valve 51 arranged in the suction line 50 is connected via a line 85 to a switch 89 arranged at the machine jacket or panelling 78, which switch is actuated via a actuating element 90 of the maintenance device 16. A control device 56 which is connected via a line 55 to the drive motor 54 is, in a similar fashion, provided via a line 88 to a switch 86 arranged at the machine jacket or housing 78 that is controllable by means of an actuating element 87 of the maintenance device 16.

Figure 5:
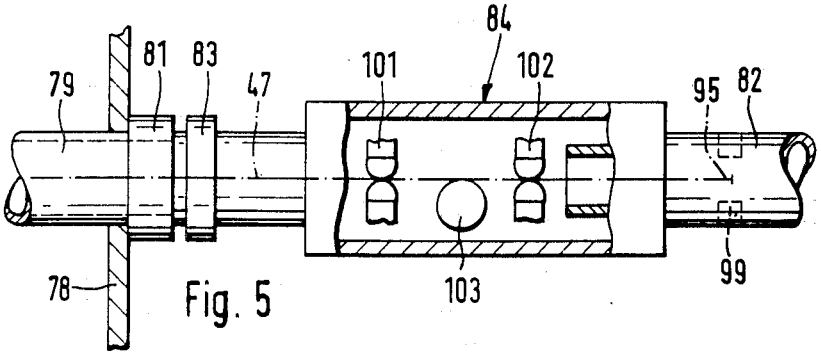
FIG. 5 is a detailed view of a portion of the maintenance device in accordance with FIG. 4.

After the yarn end 47 has been returned so far that its actual end 95 is now located in the vacuum line 82, the yarn end 47 is prepared for the piecing and treatment process by means of a device 84 arranged in the vacuum line 82. This device 84 is shown in FIG. 5. The same first includes a detector 99, that, for example, optically serves the yarn end 47 and determines whether the yarn end 47 has actually been returned, whereby it also determines the introduction of end 95 of the yarn end 47. The arrangement 84 further provides for two yarn clamps 101 and 102 assigned to the yarn end 47 between which a friction or grinding wheel 103 is located. After the existence of the yarn end 47 is established by means of the detector 99, the two yarn clamps 101 and 102 are closed. The friction wheel 103 is then brought in contact and driven to piece the yarn end 47 in a predetermined location and to simultaneously roughen the end 47 to the form of a fiber beard. Clamps 101 and 102 are subsequently released and the pieced yarn portion is sucked up as waste.

The actual start spinning process following is also entirely controlled by the movable maintenance device 16. The maintenance device 16 with its not further illustrated program control determines at which time periods the operation of rollers 13 and 14 are again resumed, and when the suction device 24 via valve 51 is again switched on. The maintenance device 16 is capable of controlling these switching steps such that the start spinning actually occurs during reduced rotational speeds of rollers 13, 14 and/or with a reduced suction effect. In order to also control the supply of the fibers to the wedge-shaped gap 18 during the start-spinning process, the feeding roller 10 is provided with a catcher wheel 96 which is assigned a counterpart 97 of an auxiliary drive 98 of the maintenance device 16 in arrow direction E. Clamping rollers 43 withdraw the yarn end 47 in normal yarn withdrawal direction F during the start-spinning process whereby simultaneously the auxiliary winding roller 33 winds the same upon spool 8. After a successful start spinning, the newly spun yarn is returned by means of arrangements not further illustrated here, to the withdrawal device 6, 7 of the spinning unit 1, whereby spool 8 is once more returned upon the winding roller 9.

Figure 6:
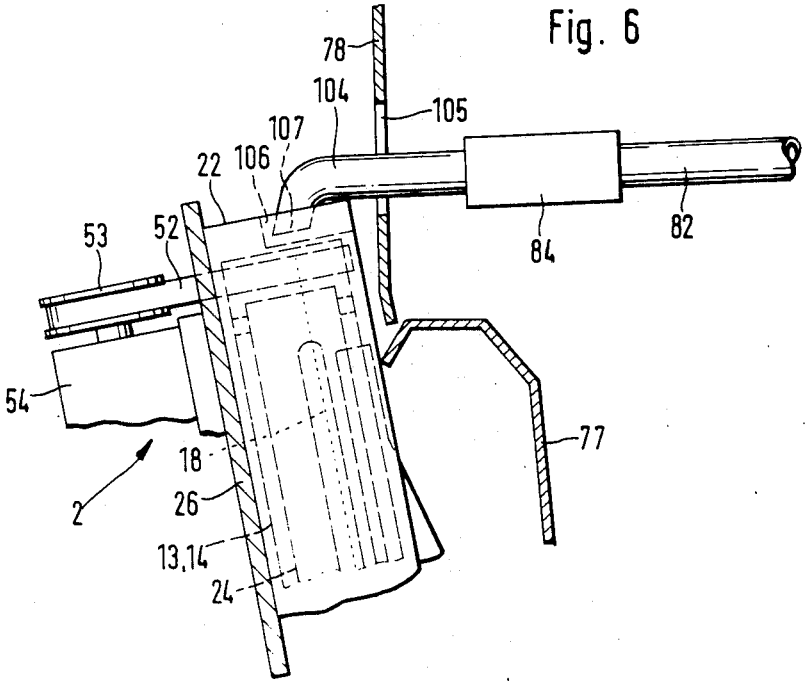
FIG. 6 is a further embodiment of a particular detail of the maintenance device in accordance with FIG. 4.

The embodiment in accordance with FIG. 6 contemplates, instead of providing a suction pipe 79 (FIG. 4) stationarily arranged at each spinning unit, providing the maintenance device 16 with a suction nozzle 107 assigned to the spinning unit in the area of a recess 106 at the end of wedge-shaped gap 18 opposite the yarn withdrawal pipe 21. The suction nozzle 107 is fixedly attached to the subpressure line 82 or the device 84 for piecing and treating the yarn end 47. The pipe 104 is transferable through an opening 105 of the machine jacket 78 into the area of recess 106, which is preferably arranged such that the same effectively centers the suction nozzle 107 to the wedge-shaped gap 18 once in its position.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. An open-end friction spinning machine having a plurality of adjacently arranged spinning units, each said unit including drivable friction surface means defining a yarn formation zone for spinning yarn, feeding and opening device means for supplying individual fibers to said yarn formation zone, suction device means for holding said fibers and forming yarn in said yarn formation zone, and yarn withdrawal device means for withdrawing yarn in a yarn withdrawal direction from said yarn formation zone, comprising:

air current producing means for producing an air current along said yarn formation zone in a direction opposite said yarn withdrawal direction, said air current producing means including at least one compressed air jet means capable of transporting a yarn end in said direction opposite said yarn withdrawal direction, and maintenance device means, said maintenance device means including said air current producing means.

2. An apparatus according to claim 1, wherein said maintenance device means includes picking up means for picking up a broken yarn end at a respective unit, yarn end returning means for returning a yarn end to said spinning unit, feed control means for controlling the feeding of fibers to the yarn formation zone, withdrawal controlling means for controlling the withdrawal of pieced yarn out of the yarn formation zone, and controlled wind-up means for winding up a pieced yarn upon a spool.

3. An apparatus according to claim 1, wherein said drivable friction surface means comprises a pair of adjacently arranged friction rollers drivable in the same rotational direction and said yarn formation zone comprises a wedge-shaped gap between the rollers.

4. An apparatus according to claim 1, wherein each said spinning unit includes yarn withdrawal pipe means extending from said yarn formation zone, said yarn withdrawal pipe means being connectable to a compressed air source for producing a compressed air current in said direction opposite said yarn withdrawal direction.

5. An apparatus according to claim 4, wherein said yarn withdrawal pipe means include channel means connectable with an air supply line for creating said air current opposite said yarn withdrawal direction.

6. An apparatus according to claim 4, further comprising movable maintenance device means, said maintenance device means including a compressed air supply line engageable with said yarn withdrawal pipe.

7. An apparatus according to claim 1, wherein said maintenance device means includes compressed air jet means engageable with each said spinning unit.

8. An apparatus according to claim 1, wherein said air current producing means comprises suction nozzle means and said maintenance device means includes suction nozzle control means for controlling said suction nozzle means.

9. An apparatus according to claim 8, wherein each said spinning unit is provided with suction pipe means adjacent said yarn formation zone, said maintenance device means including a vacuum line connectable with said suction pipe means.

10. An apparatus according to claim 8, wherein said suction nozzle means is carried by said maintenance device means.

11. An apparatus according to claim 8, wherein said maintenance device means includes yarn end detecting means for detecting a yarn end acted upon by said suction nozzle means.

12. An apparatus according to claim 8, wherein said maintenance device means includes treating means for treating a yarn end acted upon by said suction nozzle means.

13. An apparatus according to claim 1, wherein each said spinning unit includes drive interrupting means for interrupting the drive of said drivable friction surface means, said maintenance device means including control means for controlling said drive interrupting means.

14. An apparatus according to claim 1, wherein each said spinning unit includes suction effect interrupting means for interrupting operation of said suction device means, said maintenance device means including a suction effect control means for controlling said suction device interrupting means.

15. An apparatus according to claim 12, wherein said treating means comprises yarn end roughening means for forming a fiber beard at said yarn end.

16. An apparatus according to claim 1, wherein said drivable friction surface means comprises at least one cylinder means rotatable about a longitudinal axis and said yarn formation zone comprises a substantially linear region extending along the line adjacent said friction surface means, said line being substantially coplanar with said longitudinal axis.

17. A process for open-end friction spinning using a spinning machine having a plurality of adjacently arranged spinning units each provided with drivable friction surface means for forming a yarn formation zone, feed and opening device means for supplying individual fibers to said yarn formation zone, suction device means for holding said fibers and forming yarn produced in said yarn formation zone, and yarn withdrawal device means for withdrawing yarn from said yarn formation zone in a yarn withdrawal direction, comprising:

producing an air current along said yarn formation zone in a direction opposite said yarn withdrawal direction, said producing of an air current including using at least one compressed air jet meant included in a maintenance device means capable of transporting a yarn end in said direction opposite said yarn withdrawal direction, and transporting a broken yarn end into said yarn formation zone with said air current produced in said direction opposite said yarn withdrawal direction.

18. A process according to claim 17, wherein said drivable friction surface means comprises at least one cylinder means rotatable about a longitudinal axis and said yarn formation zone comprises a substantially linear region extending along the line adjacent said friction surface means, said line being substantially coplanar with said longitudinal axis.

19. A process according to claim 17, wherein said drivable friction surface means comprises a pair of adjacently arranged friction rollers drivable in the same rotational direction and said yarn formation zone comprises a wedge-shaped gap between the rollers.

20. An open-end friction spinning machine having a plurality of adjacently arranged spinning units, each said unit including drivable friction surface means defining a yarn formation zone for spinning yarn, feeding and opening device means for supplying individual fibers to said yarn formation zone, suction device means for holding said fibers and forming yarn in said yarn formation zone, and yarn withdrawal device means for withdrawing yarn in a yarn withdrawal direction from said yarn formation zone, comprising:

air current producing means for producing an air current along said yarn formation zone in a direction opposite said yarn withdrawal direction, said air current producing means including at least one compressed air jet means capable of transporting a yarn end in said direction opposite said yarn withdrawal direction, and yarn withdrawal pipe means extending from said yarn formation zone, said yarn withdrawal pipe means being obliquely connectable to the compressed air jet means.

21. An apparatus according to claim 20, comprising maintenance device means, said maintenance device means including said air current producing means.

22. An apparatus according to claim 4, wherein said compressed air source is obliquely connected to said yarn withdrawal pipe means.

23. An apparatus according to claim 1, wherein each said spinning unit includes yarn withdrawal pipe means extending from said yarn formation zone, said yarn withdrawal pipe means being obliquely connected to said compressed air jet means.

* * * * *